United States Patent [19]

Seeger et al.

[11] Patent Number: 5,018,272

[45] Date of Patent: May 28, 1991

[54] METHOD OF MAKING AN EXHAUST CATALYST BY SECURING WIRE MESH ONTO AN ARBOR

[75] Inventors: Walter Seeger, Gaggenau; Rüdiger Mussler, Rastatt; Reinhard Häfelein, Kuppenheim, all of Fed. Rep. of Germany

[73] Assignee: Roth Technik GmbH, Gaggenau, Fed. Rep. of Germany

[21] Appl. No.: 330,607

[22] Filed: Mar. 29, 1989

[30] Foreign Application Priority Data

Apr. 5, 1988 [IT] Italy ..... 3811411

[51] Int. Cl.[5] ..... B23P 15/26

[52] U.S. Cl. ..... 29/890.08; 29/419.1; 29/425

[58] Field of Search ..... 29/33 F, 157 R, 419.1, 29/425, 406, 439, 464, 465, 902; 72/353; 140/71 C, 107; 277/230, 236; 422/179, 180

[56] References Cited

U.S. PATENT DOCUMENTS 3,303,806 2/1967 Whiteford ..... 72/353 X
3,955,643 5/1976 Clark ..... 29/157 R X
4,144,627 3/1979 Noda et al. ..... 29/157 R
4,163,042 7/1979 Lynch ..... 29/157 R X

FOREIGN PATENT DOCUMENTS 39054 3/1982 Japan ..... 72/353
179529 10/1983 Japan ..... 72/353

*Primary Examiner*—Timothy V. Eley
*Assistant Examiner*—Peter D. B. Vo
*Attorney, Agent, or Firm*—Max Fogiel

[57] ABSTRACT

A method for producing a tubular-shaped wire mesh which serves as cladding for catalytically coated cylindrical one-piece ceramics units used to decontaminate exhausts of internal combustion engines. These units function as catalysts and have a wire mesh wrapped along a circumference and around the surface of an arbor of the unit. The wrapping is such that the mesh is axially longer than the distance between two end faces of the units. The mesh has a section projecting axially beyond each end face of the unit. The wire mesh is secured to the surface of the arbor in an area which is directly adjacent to the projecting section. The projecting section is compressed into a bead to a predetermined axial extent.

15 Claims, 2 Drawing Sheets

METHOD OF MAKING AN EXHAUST CATALYST BY SECURING WIRE MESH ONTO AN ARBOR

BACKGROUND OF THE INVENTION

The invention concerns a wire mesh, a method of manufacturing it, and a device for carrying out the method.

Preferably cylindrical one-piece ceramic units are employed to decontaminate the exhausts from internal-combustion engines. The unit is securely mounted in a housing with a wire mesh between the two components. In the known method of manufacture, the unit is provided with the mesh and the two components are positioned loose in the two-part housing, which is then subjected to pressure to close it. The pulsating stream of exhaust, however, tends to shift the unit back and forth, and attempts have been made to eliminate this motion by the application of radial force in the form of a molded-in bead. These attempts have not been successful because too much pressure while the ceramic unit is being assembled can damage it. Too little pressure on the other hand may not hold the components together securely enough.

Introducing an annular groove into the edge of the end of the separate components (German OS 2 412 863) or positioning a multilayer and accordingly reinforced wire mesh at that location (German OS 3 519 965) to accommodate the axial forces on the unit has accordingly been proposed.

The drawbacks to the catalysts manufactured by the known method derive from the forces that act on the unit not only during assembly but also in operation to prevent the pulsating flow of gas that occurs in internal-combustion engine exhausts from forcing the unit against the housing and damaging it. The drawback of multiply wrapping the unit in order to reinforce its edges as in the second aforementioned method is that the extra layers create a lot of surface pressure at the edge of the unit, which can accordingly be damaged.

The object of the present invention is to propose a wire mesh, a method of manufacturing it, and a device for carrying out the method that will ensure maximum protection of the unit not only while it is being assembled but also while it is in operation.

SUMMARY OF THE INVENTION

This object is attained as recited in the claims.

A flat wire mesh is accordingly subjected to several shaping operations that preferably result in a tube with slanting impressions and wrapped around a surface, preferably an arbor, that matches the shape and size of the cylindrical unit. The tension between the unit and its metal housing can be established by the depth or height of the impressions. The sections of mesh that extend axially beyond each end of the arbor can be forced down to produce a bead that will project both axially and radially into the volume of the unit that will accommodate it. The separately shaped wire mesh is then mounted on the unit by means of a conical sleeve, which is then removed. The unit, now enclosed in the mesh can then be inserted into a two-part housing, wherein it will be reliably secured to the extent that the axial distance between the unit and the housing will be constant and that the joint between the unit and the housing will be radially resilient, although any axial forces will be accommodated. The bead will influence not only the density but also the axial resilience. Both the bead and its resilience, which differs from the resilience at other sites in the mesh, will accommodate the longitudinal tolerances between the unit and the housing. Finally, the assembly will be sealed against an undesired bypass flow on the part of the exhaust. The pressure against the surface of the unit that is not covered by the bead on the mesh, however, will be uniform.

In one embodiment of the method in accordance with the invention the wire mesh can be wrapped directly on to the unit and its edges subjected to longitudinal force. This approach requires a backing that will accommodate the forces and protect the unit and that can be removed later. The mesh can, before it is wrapped into a tube, also be provided with impressions that extend at an acute angle to its circumference. Once the assembly has been forced together, the impressions will create a certain axial resilience that will force the compressed bead securely against the faces of the unit in spite of the backing. Alternatively or additionally, the mesh can be slightly pulled apart axially before the bead is produced to ensure that the bead will be tightly secured due to the resilience of the mesh once the assembly has been forced together.

When, as in a preferred embodiment, the surface has an elevation around the edge at each end that creates an indentation in the bead, the especially sensitive edges of the ceramic unit will to an additional advantage not rest directly against the wire mesh, but only in the indentation created by the elevation.

Further practical embodiments and developments of the invention are recited in the subsidiary claims.

A preferred embodiment of a device for carrying out the method and the sequence in which the method is carried out are illustrated by way of example in the drawing, wherein

DESCRIPTION OF THE PREFERRED EMBODIMENTS

Figure 1:
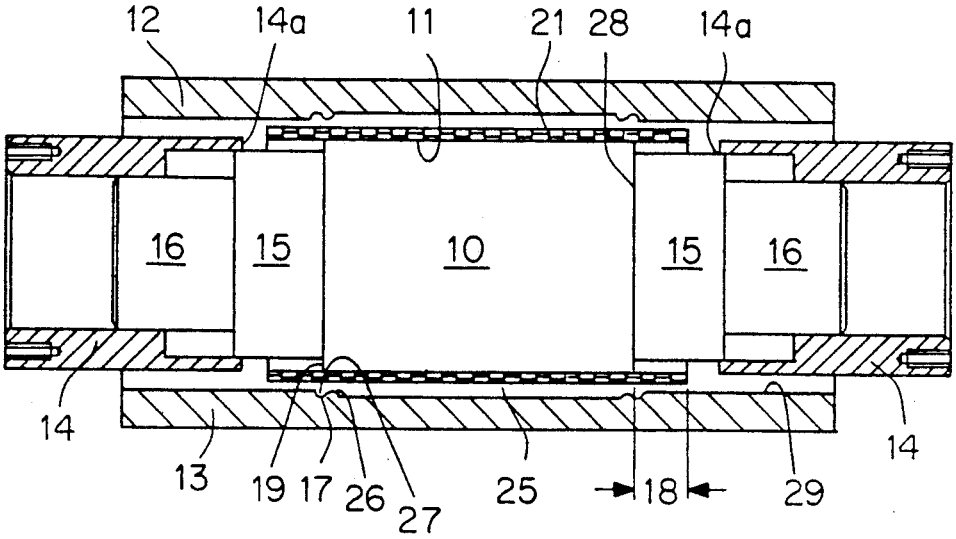
FIG. 1 is a schematic and partly broken-open section through a device for carrying out the method as represented during its first stage.
Figure 3:
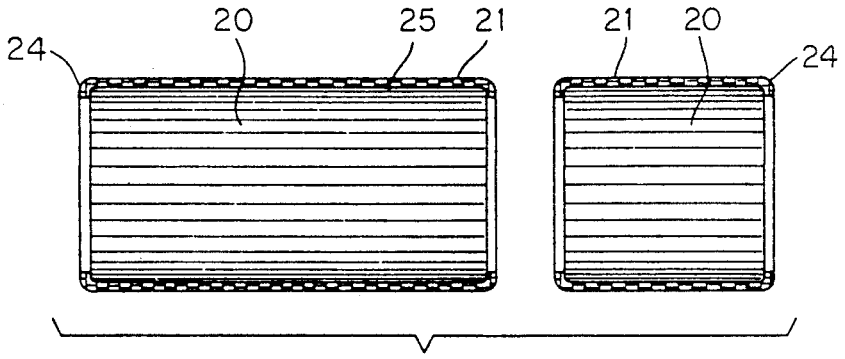
FIG. 3 shows a previously shaped mesh stripped onto a unit.
Figure 4:
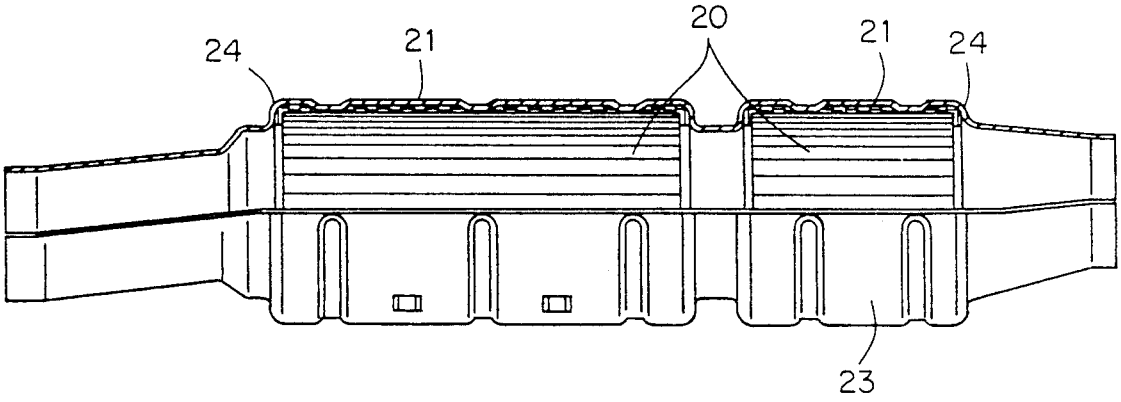
FIG. 4 is a schematic section through half of the assembly showing the components illustrated in FIG. 3 accommodated in the housing.

FIG. 1 illustrates a device. It has an arbor 10 with a surface 11 that matches the shape and size of a ceramic unit 20 (FIGS. 3 and 4). A wire mesh 21 is wrapped, preferably twice, around the surface 11 and along the circumference of arbor 10. Mesh 21 is wide enough to leave a section 18 projecting at each end of the arbor. The arbor is accommodated between two shaping jaws 12 and 13 that surround it with radial play while leaving its ends free and that can be moved toward each other. The actual compression tools are two sleeves 14 that can be displaced in and out of the axial openings at each side of jaws 12 and 13.

Arbor 10 has a shorter-diameter segment 15 at each end where section 18 of the mesh projects beyond surface 11. Each segment 15 is succeeded by another segment 16 of even shorter diameter that functions as a guide for a sleeve 14. The actual projecting shaping surface of each sleeve 14 rests against the surface of a segment 15 and has a furtherprojecting lip 14*a* on its face that engages a matching groove 17 in the annular face 19 between initial segment 15 and the surface 11 of the arbor when the sleeve is fully engaged. The groove is directly adjacent to the surface of segment 15.

Figure 2:
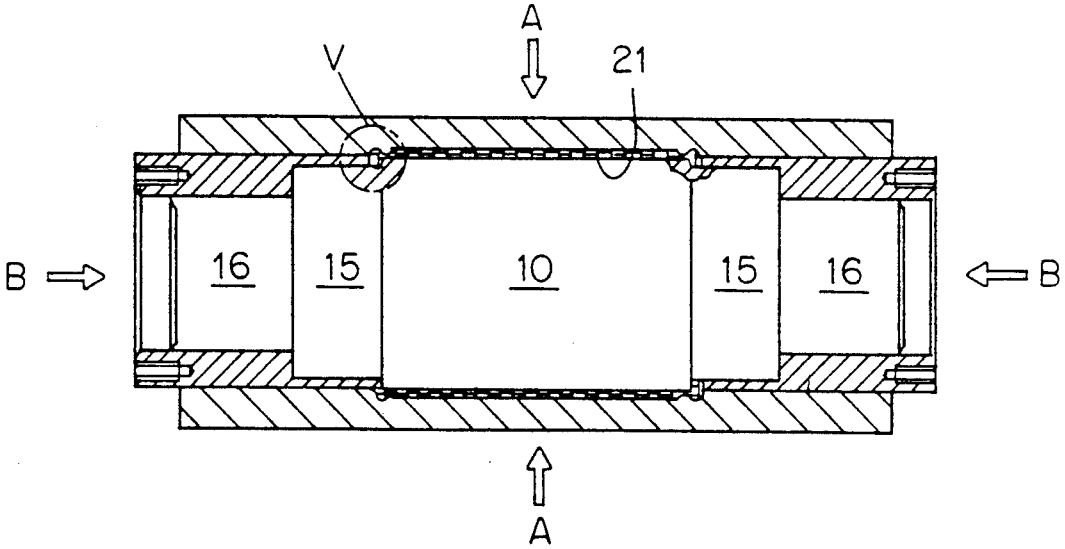
FIG. 2 is the same section shown in FIG. 1 but represented upon termination of the application of pressure.

Jaws 12 and 13 also have an annular space 25 of longer diameter in the vicinity of the surface 11 of arbor 10 that prevents excessive compression of mesh 21 in that area when jaws 12 and 13 are introduced in the direction indicated by arrows A (FIG. 2). At each end of annular space 25, an elevation 26 extends around the total circumference and secures mesh 21 in position while sleeves 14 travel in in the direction indicated by arrows B and compress projecting section 18. Continuous securing elevation 26 has a notch 27 in the vicinity of each edge 28, which are also continuous, of surface 11 at face 19. Notch 27 merges into a section 29 of jaws 12 and 13 that has a diameter shorter than that of annular space 25. This device shapes a dimensionally stable wire mesh (FIG. 3) with a bead 24. The mesh will extend beyond the continuous edges at each end of unit 20 and may project slightly inward once it has been slipped over the unit as illustrated in FIG. 3. The resulting assembly (the unit with the wire mesh) is then inserted into a two-part housing 23 (FIG. 4), which is forced together. It will be reliably and lastingly protected from damage due to the axial displacements of unit 20 in the pulsating flow of gas.

We claim:

1. A method for producing a tubular shaped wire mesh serving as cladding for a catalytically coated cylindrical one-piece ceramic unit used to decontaminate exhausts of internal combustion engines, said unit functioning as catalysts and having an intake for exhaust at one end and having an exhaust outlet at another end, said unit having two end faces located at the intake and outlet ends of said unit said end faces defining a length of said unit, wrapping the wire mesh around a circumferential surface of an arbor, said wire mesh being axially longer than the length of the unit, said wire mesh having two projecting sections each extending axially beyond each end face of the unit;

securing said wire mesh to said surface of said arbor in an area between the projecting sections and thereby radially conforming said wire mesh into said circumferential surface of said arbor;

compressing each of said projecting section of said wire mesh into a bead and thereby axially securing said wire mesh to said arbor.

2. The method as defined in claim 1, further comprising wrapping said wire mesh at least twice around said circumferential surface of said arbor.

3. The method as defined in claim 1, including the step of securing said wire mesh in an area immediately adjacent to said projecting section.

4. The method as defined in claim 1, wherein said projecting sections having equal size.

5. The method as defined in claim 1, wherein diameter of said circumferential surface of said arbor is not exceeding the corresponding diameter of said unit.

6. The method as defined in claim 1, wherein said circumferential surface of said arbor has a length that does not extend beyond said length of said unit.

7. The method as defined in claim 1, wherein said circumferential surface of said arbor has an elevation extending around an edge at each end face.

8. The method as defined in claim 1, wherein said wire mesh is prevented from yielding radially outward by a stop during axial compression.

9. The method as defined in claim 1, including the step of bending said wire mesh simultaneously inward radially during axial compression.

10. The method as defined in claim 1, wherein said unit has a circumferential surface of same shape as the circumferential surface of said arbor.

11. The method as defined in claim 1, including the step of drawing said wire mesh over said unit after compression of the wire mesh.

12. The method as defined in claim 11, including the step of inserting at least one said unit with said compressed wire mesh thereon in a first component of a two-part housing, positioning a second component having said unit with said compressed wire mesh inserted therein on top of said first component, and joining said first component and said second component together into said two-part housing.

13. The method as defined in claim 1, including the step of providing said wire mesh with impressions extending around said wire mesh at an acute angle to a circumference of said wire mesh before said step of wrapping said wire mesh along circumferential surface and around said circumferential surface of said arbor.

14. The method as defined in claim 13, wherein said impressions extend at an angle of 50 to 70 degrees to said circumference of said wire mesh.

15. The method as defined in claim 13, wherein said impressions are parallel to one another.

* * * * *